United States Patent [19]

Hamasaki et al.

[11] Patent Number: 4,761,894

[45] Date of Patent: Aug. 9, 1988

[54] DRYING FURNACE FOR USE IN COATING DRYING

[75] Inventors: Shuji Hamasaki; Michio Taniguchi, both of Toyota; Masanori Yokoi, Aichi; Shunichi Akiyama; Yasuo Tokushima, both of Toyota, all of Japan

[73] Assignees: Trinity Industrial Corporation, Tokyo; Toyota Jidosha Kabushiki Kaisha, Toyota, both of Japan

[21] Appl. No.: 947,250

[22] Filed: Dec. 29, 1986

[30] Foreign Application Priority Data

Dec. 27, 1985 [JP] Japan ..... 60-293220

[51] Int. Cl.[4] ..... F26B 23/10

[52] U.S. Cl. ..... 34/39; 34/40; 34/243 C; 432/209; 118/58

[58] Field of Search ..... 34/243 C, 39, 40; 432/209; 118/58, 61

[56] References Cited

U.S. PATENT DOCUMENTS 3,920,382 11/1975 Hovis et al. ..... 432/209

4,383,378 5/1983 Lockwood ..... 34/105

4,546,553 10/1985 Best ..... 34/39

FOREIGN PATENT DOCUMENTS 60-10194 1/1985 Japan .

60-183070 12/1985 Japan .

*Primary Examiner*—Larry I. Schwartz

*Attorney, Agent, or Firm*—Cushman, Darby & Cushman

[57] ABSTRACT

A drying furnace for use in coating drying in which a hot gas recycling duct for emitting radiation heat is disposed on the inlet zone of a tunnel-like furnace main body and resin-removing ducts are disposed along the ceiling of the inlet zone and the exit zone of the furnace main body respectively, wherein the furnace main body is turned in a U-shaped configuration so that the inlet and the exit thereof are arranged side by side, and the hot gas supplied to the hot gas recycling duct is supplied to each of resin-removing the ducts. Resinous substances can surely be prevented from forming and depositing at both of the inlet and the exit of the furnace and the cleaning work for the resin-removing ducts can be saved.

6 Claims, 3 Drawing Sheets

DRYING FURNACE FOR USE IN COATING DRYING

BACKGROUND OF THE INVENTION

1. Field of the Invention

This invention concerns a drying furnace for use in heating and drying paint films coated on articles and, particularly, it relates to a drying furnace for use ih coating drying in which ducts are disposed along the ceiling at the inlet and the exit zones of a tunnel-like furnace main body for preventing resinous substances from being formed therein.

2. Description of the Prior Art

In a drying furnace used for use in coating drying in which car bodies just after the coating applied thereto is baked and dried during transportation of the car bodies within a furnace main body of tunnel-like shape, noxious and smelly ingredients such as organic solvents, paint resins and curing agents are released from the coated films on the car bodies when they are heated to a high temperature within the furnace.

As the concentration of the noxious and smelly ingredients is increased, sticky resinous substances that may cause yellowing or ply-separation of coated films are yielded in a great amount at the inlet zone and the exit zone of the furnace main body where the internal temperature is lowered due to the intrusion of atmospheric air. These are deposited to the ceiling and fall in the form of liquid droplets to the surface of the car bodies thereby causing defective coatings and even resulting in fire danger. Countermeasures for reducing the formation and deposit of such resinous substances have been proposed, for instance, as disclosed in Japanese Patent Laid Open Nos 10194/1985 and 183070/1985. This prior art discloses providing heating means at the inlet and the exit of a furnace main body for keeping the temperature of the exhaust gases from lowering, thereby preventing the resinous substances from being yielded.

As shown in FIG. 3 (which shows a prior art coating-drying furnace having conventional resinous substance-abatement means), exhaust gases in the furnace main body 1 are discharged through an exhaust duct 2 to a deodorizing and purifying device 3 and, in addition, a hot gas at a high temperature is supplied under circulation to each of ducts 4 and 5 disposed along the ceiling of the inlet zone 1*a* and the exit zone 1*b* of the furnace main body to prevent the temperature of the exhaust gases from lowering in the inlet zone 1*a* and the exit zone 1*b*.

In a drying furnace for baking and drying the paint films coated on a car body B just after the electrodeposition of such coating films, hot gas recycling ducts 6 referred to as "far-infrared dust" are disposed along the right and left walls on the side of the inlet zone 1*a* in the furnace main body 1. A hot gas at a high temperature from 250° to 300° C. is supplied into the ducts 6 under circulation from hot gas generation device $N_1$ so that the coated wet films on the car body B are dried to some extent by radiation heat at about 200° C., radiated from radiation plates 7 disposed in front of the ducts. Then, after the surface of the coated films has been dried, the films are baked and dried by the hot gas at a temperature from 170° to 180° C. blown out from the blowing ports 9 of hot gas duct 8. In this way, for rapidly increasing the temperature of the car body B conveyed into the furnace main body 1 and drying the coated wet films just after the electrodeposition with good luster without depositing dust or the like, the surface of coated films is at first dried by radiation heat at about 200° C., radiated from the radiation plates 7 of the hot gas recycling ducts 6. Then, a hot gas at about 170° to 180° C. blown out from the blowing ports 9 of the hot gas duct 8 and circulated under convection within the furnace is directly blown to cause a curing reaction in the coated films at a good heat efficiency.

Then, the hot gas at a high temperature supplied to the inside of the hot gas recycling ducts 6 is supplied for energy saving to the inside of the duct 4 disposed at the inlet 1*a* of the furnace main body 1 for preventing the formation of resinous substances and, thereafter, again heated to a temperature about from 250° to 300° C. while receiving heat from burner 10 in the hot gas generating device $N_1$ and supplied under circulation to the inside of the hot gas recycling ducts 6 by recycling blower 11. Further, a portion of the hot gas sent to the inside of the hot gas duct 8 is supplied to the inside of the duct 5 disposed at the exit 1*b* of the furnace main body for preventing the formation of resinous substances and then heated to a temperature about from 170° to 180° C. while receiving heat from burner 13 in hot gas generating device $N_2$ together with the air in the furnace sucked from suction blower 14 and then supplied under circulation by recycling blower 14 to the hot gas duct 8.

In this case, since the duct 4 disposed at the inlet 1*a* of the furnace main body 1 for preventing the formation of resinous substances is heated by a clean hot gas at high temperature (at 250° to 300° C.) under circulation to the hot gas recycling ducts 6, the temperature at the inside of the inlet 1*a* can be maintained at a high level to reliably prevent the formation of resinuous substances, as well as to keep the inside of the duct 4 per se free from contamination due to the deposition of resinous substances.

However, since the hot gas at a relatively low temperature about from 170° to 180° C. is supplied from the hot gas duct 8 to the inside of the duct 5 disposed at the exit 1*b* of the furnace main body 1 for preventing the formation of resinous substances, the temperature at the surface of the duct 5 is liable to be lowered under the effect of the atmospheric air at a low temperature that intrudes from the exit 1*b* to yield and deposit resinous substances onto the surface of the duct 5. Amounts of the deposited resinous substances fall dropwise, if accumulated to a certain extent, to the surface of the car body B and result in the serious drawback of a defective coating. Particularly, in other types of drying furnaces than the electrodeposition furnace described above, since the temperature of the hot gas supplied under circulation to the inside of the hot gas duct 8 is extremely low such as from 130° to 140° C. in a sealer furnace, from 150° to 160° C. in an intermediate coating furnace, from 120° to 140° C. in a water polishing furnace and from 140° to 150° C. in a top coating furnace, great amounts of resinous substances are formed and deposited due to the lowering in temperature.

Further, since a hot gas containing noxious and smelly ingredients circulated in the inside of the furnace and sucked from the suction duct 12 is supplied under circulation to the inside of the duct 5 for preventing the formation of resinous substances, there has also been a drawback that the resinous substances are formed and deposited on the inside of the duct 4 as well thereby necessitating extremely troublesome cleaning work.

OBJECT OF THE INVENTION

It is, accordingly, an object of this invention to provide a drying furnace for use in coating in which a clean hot gas at high temperature to be supplied to the hot gas recycling duct disposed on the side of the inlet of the furnace main body is supplied at a high heat efficiency not only into a duct disposed in the inlet zone of the furnace main body but also into a duct disposed in the exit zone of the furnace main body for preventing the formation of resinous substances, so that resinous substances can surely be prevented from being formed and deposited onto the internal wall surfaces and within the inside of these ducts.

SUMMARY OF THE INVENTION

The foregoing object can be attained in accordance with this invention by a drying furnace for use in coating drying in which a hot gas recycling duct for emitting radiation heat is disposed on the side of the inlet zone of a furnace main body in a tunnel-like shape and ducts are disposed along the ceiling of the inlet zone and the exit zone of the furnace main body respectively for preventing the formation of resinous substances, wherein the furnace main body is constituted as a furnace turned in a U-shaped configuration so that the inlet and the exit thereof are arranged side by side in adjacency with each other, and the hot gas supplied to the hot gas recycling duct is supplied to each of the ducts for preventing the formation of resinous substances.

According to this invention, the hot gas at a high temperature supplied to the hot gas recycling duct disposed on the side of the inlet of the furnace main body is supplied not only to the inside of the duct disposed at the inlet of the furnace main body but also to the inside of the duct disposed at the exit of the furnace main body, for preventing formation of resinous substances respectively, so that the resinous substances can surely be prevented from yielding and depositing onto the surface and within each of the ducts. Particularly, since the furnace main body is shaped as a U-turned configuration so that the inlet and the exit zones thereof are arranged side by side in adjacency with each other, it is possible to reduce the path length of the duct for supplying the hot gas under circulation from the inside of the hot gas recycling duct disposed in the inlet zone of the furnace main body to the inside of the duct disposed in the exit zone of the furnace main body for preventing the formation of resinous substances, whereby the amount of the heat dissipated can be reduced and thus the heat efficiency can be improved, and the cost for installing the supply duct can be reduced substantially.

DESCRIPTION OF THE ACCOMPANYING DRAWINGS

These and other objects, as well as advantageous features of this invention will become apparent by reading the following descriptions for the preferred embodiment of this invention while referring to the accompanying drawings, wherein, FIG. 1 is a diagrammatic top plan view illustrating one embodiment of a drying furnace for use in coating drying according to this invention;

FIG. 2 is a transverse cross-sectional view thereof taken along line II—II in FIG. 1; and FIG. 3 is a diagrammatic fragmentary vertical longitudinal cross-sectional view illustrating a conventional drying furnace for use in coating.

DESCRIPTION OF THE PREFERRED EMBODIMENT

Figure 1:
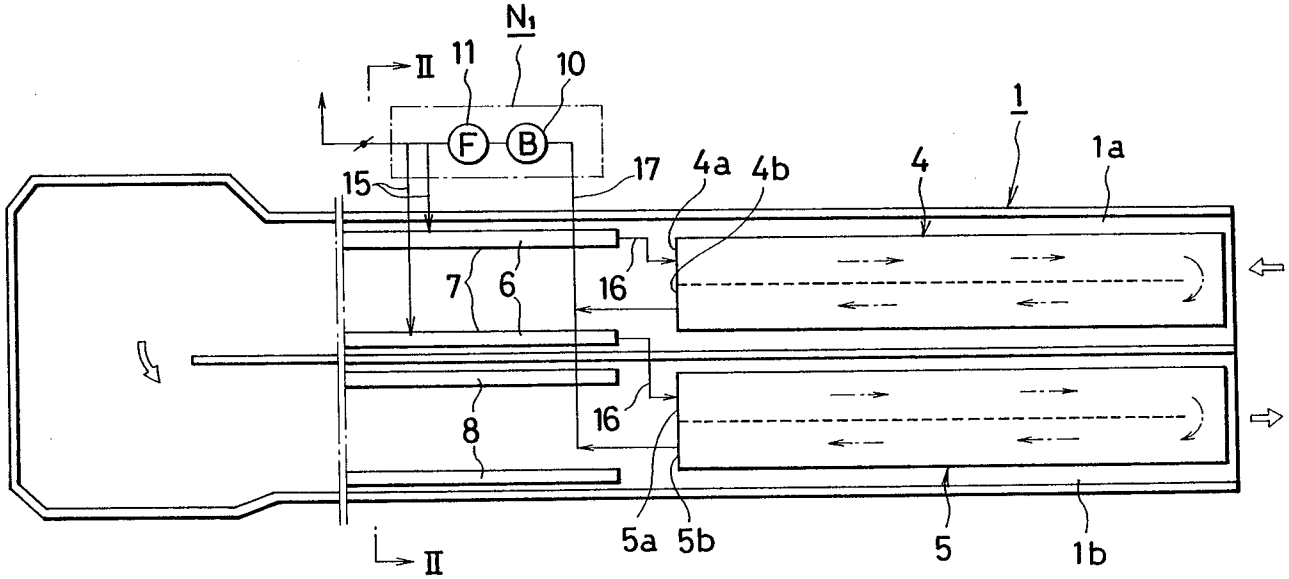

This invention will now be described more specifically by way of a preferred embodiment while referring to the drawings.

Figure 2:
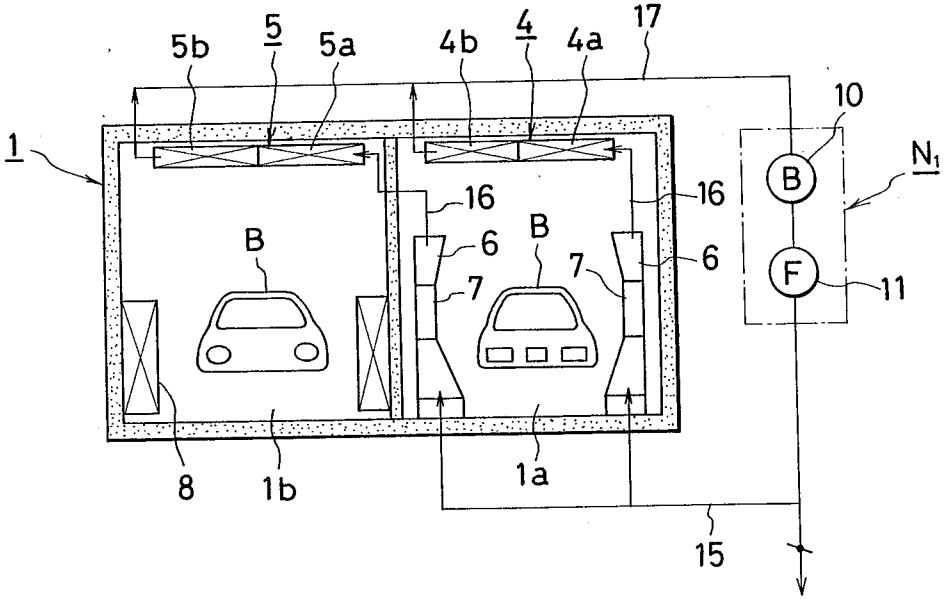
Figure 3:
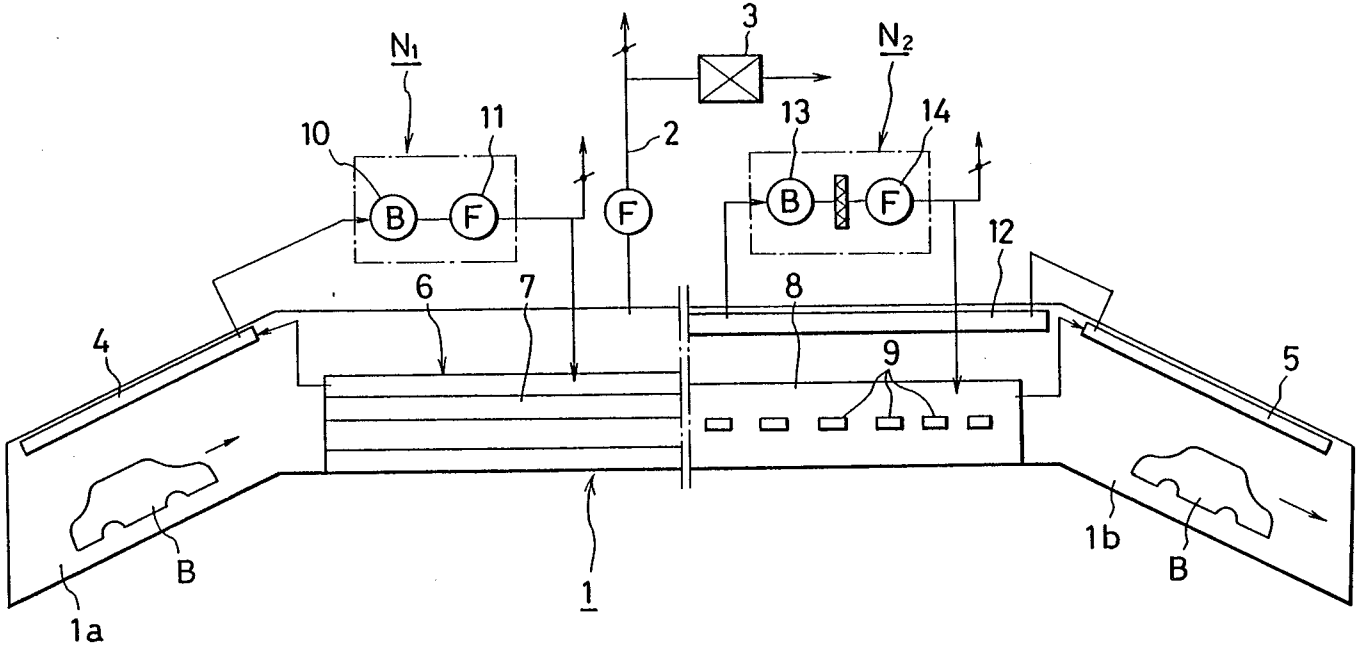
FIG. 3 (PRIOR ART)

In the following descriptions referring to FIGS. 1 and 2, portions identical to those which have been described hereinabove with reference to FIG. 3 carry the same reference numerals and detailed explanations therefor are omitted. In FIG. 1, as in FIG. 3, the segment of the main furnace body sandwiched between the inlet zone and the outlet zone is the effective drying zone.

A furnace main body 1 is turned in a U-shaped configuration so that inlet zone 1*a* and exit zone 1*b* formed at respective ends of an effective drying zone are arranged side by side in adjacency with each other.

Further, paired of hot gas recycling duct 6 and hot gas blowing duct 8 are respectively disposed in the inlet zone 1*a* and the exit zone 1*b* in the furnace main body 1 along the side walls on the right and left.

Ducts disposed along the ceiling of the inlet zone 1*a* and the exit 1*b* of the furnace main body 1 for preventing the formation of resinous substances (hereinafter simply referred to as resin-removing ducts) 4 and 5 are constituted each in the form of a U-turned duct in which entrance 4*a* and outlet 4*b* are disposed in adjacency with each other, while an entrance 5*a* and an outlet 5*b* are disposed in adjacency with each other.

Each of the entrances 4*a* and 5*a* of the resin-removing ducts 4 and 5 is connected to duct 16 for emitting a hot gas at a high temperature supplied from supply duct 15 of hot gas generation device $N_1$ through the inside of the hot gas recycling duct 6 respectively, while each of the outlets 4*b* and 5*b* is connected to a return duct 17 of the hot gas generation device $N_1$ respectively.

That is, in this embodiment according to this invention, the resin-removing duct 5 disposed in the exit zone 1*b* of the furnace main body 1 is not supplied with a hot gas from the hot blow blowing duct 8 as in the prior art, but is supplied with a clean hot gas at high temperature from the hot recycling duct 6 disposed in the inlet zone 1*a*.

A hot gas at a high temperature heated to about 250°-300° C. by the burner 10 of the hot gas generation device $N_1$ is supplied by way of recycling blower 11 through supply duct 15 to the inside of the hot gas recycling duct 6 to raise the temperature of the heat irradiation plate 7 disposed in front of the hot gas recycling duct 6 to about 200° C., whereby the coated wet films on a car body (not illustrated) just after coating electrodeposition is heated to dry the coating radiation heat from the hot gas. At the same time the hot gas supplied to the inside of the hot gas recycling blower 6 is supplied through the duct 16 to the inside of each of the resin-removing ducts 4 and 5 and the temperature in the inlet zone 1*a* and the exit zone 1*b* of the furnace main body is heated to a high temperature by the heat from each of the resin-removing ducts 4 and 5.

This can prevent the resinous substances from being formed out of the exhaust gases containing noxious and smelly ingredients in the inlet zone 1*a* and the exit zone 1*b*. Further, since each of the resin-removing ducts 4 and 5 is heated to a high temperature by the hot gas at about 250°–300° C. supplied from the inside of the hot gas recycling duct 6, there is no remarkable reduction in the surface temperature of the ducts if atmospheric air at low temperature intrudes through the outer ends of the inlet zone 1*a* and the exit zone 1*b*, and deposition of the resinous substances onto the surfaces of the ducts 4 and 5 can be prevented.

Then, the hot gas supplied into the resin-removing ducts 4 and 5 as described above is returned from each of the outlets 4*b* and 5*b* through the return duct 17 to the hot gas generation device $N_1$, heated again by the burner 10 in the hot gas generation device $N_1$ and then supplied under circulation by the recycling blower 11 to the inside of the hot gas recycling duct 6.

Accordingly, since the hot gas supplied under circulation from the hot gas recycling duct 6 to each of the resin-removing ducts 4 and 5 is quite clean air not containing the noxious and smelly ingredients generated in the furnace main body 1, no resinous substances are formed and deposited onto the inside of the resin-removing ducts 4 and 5 and the inside of the ducts can be cleaned with ease.

Further, since the furnace main body 1 doubles back in a U-shaped configuration so that the inlet zone 1*a* and the exit zone 1*b* are arranged side by side in adjacency with each other, the length of the duct 16 for supplying the hot gas from the hot gas recycling duct 6 disposed in the inlet zone 1*a* to the inside of the resin-removing duct 5 disposed in the exit zone 1*b* can be shortened substantially, by which the heat efficiency can be improved, the heat dissipation amount from the duct 16 can be reduced substantially, and the cost for disposing the duct 16 can be reduced.

As has been described above according to this invention, since a clean hot gas at high temperature supplied to the hot gas recycling duct for heating the inside of the furnace by radiation heat is supplied not only to the inside of the resin-removing duct disposed in the inlet zone of the furnace main body but also to the inside of the resin-removing duct disposed in the exit zone of the furnace main body, formation and deposition of the resinous substances onto the surface and inside of each of the resin-removing ducts can reliably be prevented. Further, since the furnace main body is arranged in a U-shaped configuration so that the inlet zone and the exit zone thereof are arranged side by side in adjacency with each other, it is possible to substantially shorten the path length of the duct for supplying the hot gas under circulation from the hot gas recycling duct disposed in the zone of the furnace main body to the inside of the resin-removing duct disposed in the exit zone thereof, whereby the heat dissipation amount from the duct is reduced and thus the heat efficiency is much improved, and the cost for installing the ducts can be reduced substantially.

What is claimed is:

1. A drying furnace for drying a coating on an article while the article is being moved therethrough, said furnace comprising:

left and right sidewall and ceiling means defining a tunnel-like furnace main body of U-shaped plan figure having two laterally-opposite legs, and including, in series, an inlet zone including an inlet to said furnace main body, an effective drying zone, and an exit zone including an exit from said furnace main body, said inlet zone and said exit zone being disposed laterally adjacent one another; said sidewall and ceiling means enclosing a path for movement of an article having a coating to be dried, so that said article may be successively moved into said furnace main body through said inlet of said inlet zone, along said inlet zone, along said effective drying zone, along said exit zone and out of said furnace main body through said exit;

said furnace main body being provided internally thereof on said ceiling-means in said inlet zone and said exit zone with a respective resin deposition prevention duct through which hot gas may be circulated for maintaining a high temperature in said inlet zone despite proximity of said inlet and for maintaining a high temperature in said exit zone despite proximity of said exit;

said furnace main body being provided internally thereof on said sidewall means in said effective drying zone with coating-drying hot gas recirculating duct means for radiating heat to said article as said article is being moved along said path in said effective drying zone;

burner means including blower means associated therewith, said blower means having a pressure side and a suction side;

supply duct means communicating said burner means with said resin deposition prevention ducts and with said hot gas recirculating duct means, so that gas may be heated by said furnace, blown through said hot gas recirculating duct means and said resin deposition prevention ducts and at least partially recycled to said burner means for reheating.

2. The coating-drying furnace of claim 1, wherein:

each of said resin deposition prevention ducts is U-shaped in plan figure, so as to have both an upstream end and a downstream end disposed longitudinally adjacent said effective drying zone;

said supply duct means includes:

first lines communicating said burner means on said pressure side of said blower means with said coating-drying hot gas recirculating duct means serving said sidewall means of said effective drying zone;

second lines communicating said coating-drying hot gas recirculating duct means with said upstream ends of said resin deposition prevention ducts; and third lines communicating said downstream ends of said resin deposition prevention duct means with said burner means on said suction side of said blower means.

3. The coating-drying furnace of claim 2, wherein:

said burner means is located laterally adjacent said effective drying zone for minimizing said supply duct means first lines in length.

4. The coating-drying furnace of claim 3, wherein:

in use, said burner and supply duct means first lines supply hot gas at 250°–300° C. to said coating-drying hot gas recirculating duct means.

5. The coating-drying furnace of claim 4, wherein:

in use, said supply duct means second lines supply hot gas at 250°–300° C. to said resin deposition prevention ducts.

6. The coating-drying furnace of claim 5, wherein:

said coating-drying hot gas recirculating duct means include plate means facing said path and, in use, said hot gas supplied to said coating-drying hot gas recirculating duct means heats said plates to about 200° C.

* * * * *